US008490615B2

(12) United States Patent
Cudnohoske et al.

(10) Patent No.: US 8,490,615 B2
(45) Date of Patent: Jul. 23, 2013

(54) HEATED FIELD RATIONS AND ASSEMBLIES

(75) Inventors: Eric Cudnohoske, South Lebanon, OH (US); Giampaolo Vacca, Loveland, OH (US)

(73) Assignee: GHT Global Heating Technologies, GmbH, Baar (CH)

( * ) Notice: Subject to any disclaimer, the term of this patent is extended or adjusted under 35 U.S.C. 154(b) by 410 days.

(21) Appl. No.: 12/536,074

(22) Filed: Aug. 5, 2009 (Under 37 CFR 1.47)

(65) Prior Publication Data

US 2011/0073096 A1 Mar. 31, 2011

Related U.S. Application Data

(60) Provisional application No. 61/143,982, filed on Jan. 12, 2009, provisional application No. 61/086,356, filed on Aug. 5, 2008.

(51) Int. Cl.

| | |
|---|---|
| ***F24C 5/00*** | (2006.01) |
| ***F24C 5/02*** | (2006.01) |
| ***F24C 1/00*** | (2006.01) |
| ***F24C 1/08*** | (2006.01) |
| ***A61F 7/00*** | (2006.01) |
| ***A47G 23/04*** | (2006.01) |
| ***F24J 1/00*** | (2006.01) |
| ***F23D 3/40*** | (2006.01) |
| ***F23D 4/12*** | (2006.01) |
| ***B65D 85/00*** | (2006.01) |
| ***B65D 81/34*** | (2006.01) |

(52) U.S. Cl.

USPC ..... 126/93; 126/43; 126/44; 126/58; 126/79; 126/94; 126/95; 126/204; 126/208; 126/209; 126/210; 126/261; 126/262; 126/263.01; 126/263.02; 431/7; 431/326; 431/328; 426/106; 426/113; 426/114

(58) Field of Classification Search

USPC ..... 126/39 R, 43, 44, 58, 79, 93, 94, 126/95, 204, 208, 209, 210, 261, 262, 263.01, 126/263.02, 265, 266; 431/7, 147, 268, 326, 431/328; 426/106, 113, 114; 206/550

See application file for complete search history.

(56) References Cited

U.S. PATENT DOCUMENTS 2,531,548 A * 11/1950 Bennett ..... 126/263.01
3,311,459 A 3/1967 Francis et al.

(Continued)

FOREIGN PATENT DOCUMENTS

EP 0 363 494 3/1989
EP 0 356 093 8/1989

*Primary Examiner* — Kenneth Rinehart
*Assistant Examiner* — William Corboy
(74) *Attorney, Agent, or Firm* — Jenei LLC

(57) ABSTRACT

A field ration packaging assembly includes a ration housing and a food tray. The ration housing includes a lid panel having at least one air exhaust vent and a wall panel having at least one intake vent. The food tray may be positioned above a heat source. The at least one air exhaust vent and at least one air intake vent may be in fluid communication such that upon activation of the heat source, air enters the ration housing through the at least one air intake vent, passes over the heat source and exits the ration housing at the at least one exhaust vent by natural convection.

8 Claims, 12 Drawing Sheets

U.S. PATENT DOCUMENTS

| | | | | | |
|---|---|---|---|---|---|
| 3,314,413 | A | * | 4/1967 | Cambridge | 126/263.09 |
| 3,871,357 | A | * | 3/1975 | Grosso et al. | 126/263.09 |
| 4,013,061 | A | * | 3/1977 | Trumble et al. | 44/250 |
| 4,043,314 | A | * | 8/1977 | Trumble et al. | 126/263.01 |
| 4,068,651 | A | | 1/1978 | Rappaport | |
| 4,501,259 | A | * | 2/1985 | Apellaniz | 126/263.09 |
| 5,117,809 | A | | 6/1992 | Scaringe et al. | |
| 5,295,475 | A | * | 3/1994 | Kaneko | 126/263.01 |
| 5,355,869 | A | | 10/1994 | Pickard et al. | |
| 5,465,707 | A | * | 11/1995 | Fulcher et al. | 126/263.08 |
| 5,483,949 | A | * | 1/1996 | James | 126/263.05 |
| 5,611,329 | A | | 3/1997 | Lamensdorf | |
| 5,901,698 | A | | 5/1999 | Welles | |
| 5,935,486 | A | | 8/1999 | Bell et al. | |
| 6,062,210 | A | | 5/2000 | Welles | |
| 6,138,665 | A | | 10/2000 | Welles | |
| 6,200,357 | B1 | | 3/2001 | Nakajima | |
| 6,248,257 | B1 | | 6/2001 | Bell et al. | |
| 6,289,888 | B1 | | 9/2001 | Welles | |
| 6,341,602 | B1 | | 1/2002 | Fulcher | |
| 7,008,656 | B2 | * | 3/2006 | Zimmerman et al. | 426/114 |
| 7,258,117 | B2 | | 8/2007 | Payen et al. | |
| 7,507,491 | B2 | * | 3/2009 | Finkelshtain et al. | 429/410 |
| 7,575,541 | B2 | * | 8/2009 | Chen | 482/144 |
| 2002/0119229 | A1 | * | 8/2002 | Zimmerman et al. | 426/520 |
| 2004/0168684 | A1 | * | 9/2004 | Shapiro et al. | 126/265 |
| 2004/0209206 | A1 | | 10/2004 | Hockaday et al. | |
| 2007/0074715 | A1 | | 4/2007 | Hickey | |
| 2007/0259778 | A1 | | 11/2007 | Spencer et al. | |
| 2007/0272090 | A1 | | 11/2007 | Bommaraju | |
| 2008/0017184 | A1 | * | 1/2008 | Marshall et al. | 126/263.01 |
| 2008/0083725 | A1 | | 4/2008 | Stease et al. | |
| 2008/0135040 | A1 | | 6/2008 | Bommaraju | |

* cited by examiner

HEATED FIELD RATIONS AND ASSEMBLIES

CROSS REFERENCE TO RELATED APPLICATIONS

This application claims the benefit of U.S. Provisional Application Ser. No. 61/086,356, filed on Aug. 5, 2008, for Heated Field Rations and Methods of Operating the Same, and U.S. Provisional Application Ser. No. 61/143,982, filed on Jan. 12, 2009, for Heated Field Rations and Methods of Operating the Same, the entireties of which are hereby incorporated herein.

TECHNICAL FIELD

Embodiments of the present invention generally relate to field rations and, more particularly, to heated field rations and related packaging and heater assemblies for use with the same.

BACKGROUND

A field ration is a highly transportable meal used by the military and other organizations where food is to be provided to personnel operating in remote locations. In the military context, a field ration is referred to as a Meal, Ready to Eat, or "MRE." MREs are lightweight, compact and provide personnel (e.g., soldiers) with a high-calorie and quality meal while operating in the field. Field rations are available in a variety of different sizes. For example, an MRE may be designed and packaged to feed a single individual, while a Unitized Group Ration, or "UGR," is sized and designed to feed large groups of personnel or soldiers in the field.

Field rations have many other uses outside of the military context and may be consumed in any location where traditional cooking methods are not available, impractical and/or undesirable. Government and civil organizations may provide field rations to victims of natural disasters in their relief efforts. Field rations may be stored in the home or office in preparation for a natural disaster such as an earthquake or a tornado, for example. Field rations also have many commercial and residential uses, and may be used by hikers, hunters and adventurers when exploring remote areas. In addition, field rations may be consumed in the home or enjoyed at outdoor dining experiences where cooking is not possible or is undesirable.

Some varieties of field rations utilize a flameless heat source to heat the ration so that a soldier or individual may enjoy a hot meal without the need for fire. These heated field rations comprise a flameless ration heater that utilizes a water-activated reaction wherein water is mixed with magnesium to generate the requisite heat. However, this chemical reaction produces an undesired and potentially dangerous hydrogen gas. Therefore, heated field rations of this variety are not desired for activation and consumption in a tent, mess hall, home or other buildings having enclosed spaces. Moreover, a large field ration such as a UGR, because of its large size, generates a significant amount of hydrogen gas, thus making activation of several large field rations in close proximity to one another an issue.

SUMMARY

In one embodiment, a field ration packaging assembly includes a ration housing and a food tray. The ration housing includes a lid panel having at least one air exhaust vent and a wall panel having at least one intake vent. The food tray may be positioned above a heat source. The at least one air exhaust vent and at least one air intake vent may be in fluid communication such that upon activation of the heat source, air enters the ration housing through the at least one air intake vent, passes over the heat source and exits the ration housing at the at least one exhaust vent.

In another embodiment, a field ration packaging assembly includes a ration housing and a food tray. The food tray may be suspended above a heat source by a tray support. The ration housing may include a lid panel having a recirculation vent and a plurality of exhaust vents, and a wall panel having at least one intake vent. The recirculation vent, the plurality of air exhaust vents and the at least one air intake vent may be in fluid communication such that upon the activation of the heat source, air enters the ration housing through the air intake vent, passes between the food tray and the heat source and exits the ration housing at the exhaust vents.

In yet another embodiment, a field ration includes a heater system and a ration housing having a first panel and a second panel. The first panel may include at least one intake vent and the second panel may include at least one exhaust vent. The heater system may be positioned within the ration housing and include a fuel source in fluid communication with a heat source having a catalyst. The heat source is operable to create an exothermic reaction upon the contact of fuel with the catalyst, and upon initiation of the exothermic reaction, air enters into the ration housing through the at least one intake vent and exits the ration housing at the at least one exhaust vent by natural convection.

In yet another embodiment, a heater system for a field ration includes a heat pad assembly, a first activation mechanism, and a second activation mechanism. The heat pad assembly may be in communication with a fuel cartridge through at least one fuel line. The first activation mechanism may be associated with the fuel cartridge and include a pull-pin protruding from the fuel cartridge, wherein removal of the pull-pin initiates flow of fuel from the fuel cartridge into the fuel line. The second activation mechanism may be located between the heat pad assembly and the fuel cartridge, and may include a valve assembly in communication with the fuel line, wherein activation of the valve assembly initiates flow of fuel from the valve assembly toward the heat source through the fuel line.

BRIEF DESCRIPTION OF THE DRAWINGS

The embodiments set forth in the drawings are illustrative and exemplary in nature and not intended limit the inventions defined by the claims. Moreover, the individual features of the drawings will be more fully apparent and understood in view of the detailed description. The following detailed description of specific embodiments can be best understood when read in conjunction with the following drawings, where like structure is indicated with like reference numerals and in which:

DETAILED DESCRIPTION

Generally, embodiments described herein relate to heated field rations. Particularly, referring initially to FIG. 5, embodiments relate to heated field rations that utilize a modular packaging design that incorporates a flameless ration heater system to effectively heat a field ration. Embodiments may be operated and consumed in a variety of locations and under any circumstances (e.g., military operations, recreational activities, outdoor dining experiences and disaster preparedness operations). As will be discussed herein, the heated field ration may generally comprise a ration housing having one or more exhaust and/or intake vents, a tray insert, a food tray enclosing a food item or items, and a flameless ration heater system. The modular components cooperate to efficiently heat the food item or items contained within the ration housing.

As will be described in detail below, the flameless ration heater system uses a catalytic combustion heat source that, upon activation, introduces a mixture of fuel vapor and air to a catalyst located under the food tray that promotes flameless combustion of the fuel. As disclosed in U.S. Pub. No. 2004/0209206, the entire disclosure of which is hereby incorporated by reference herein, the fuel may be methanol, formaldehyde, formic acid, 1,3,5-trioxane, dimethylether, acetone, pentane and others. The catalyst may comprise a noble metal catalyst, such as platinum and/or ruthenium, for example. The flameless combustion methods described herein may provide clean and efficient heat to the food items within the heated field ration while producing water and $CO_2$ as byproducts. While U.S. Pub. No. 2004/0209206 has been incorporated herein by reference with respect to description of the heater system and/or components thereof, it should be understood that heater systems, fuels and catalysts of the present disclosure are not limited thereto.

Figure 1:
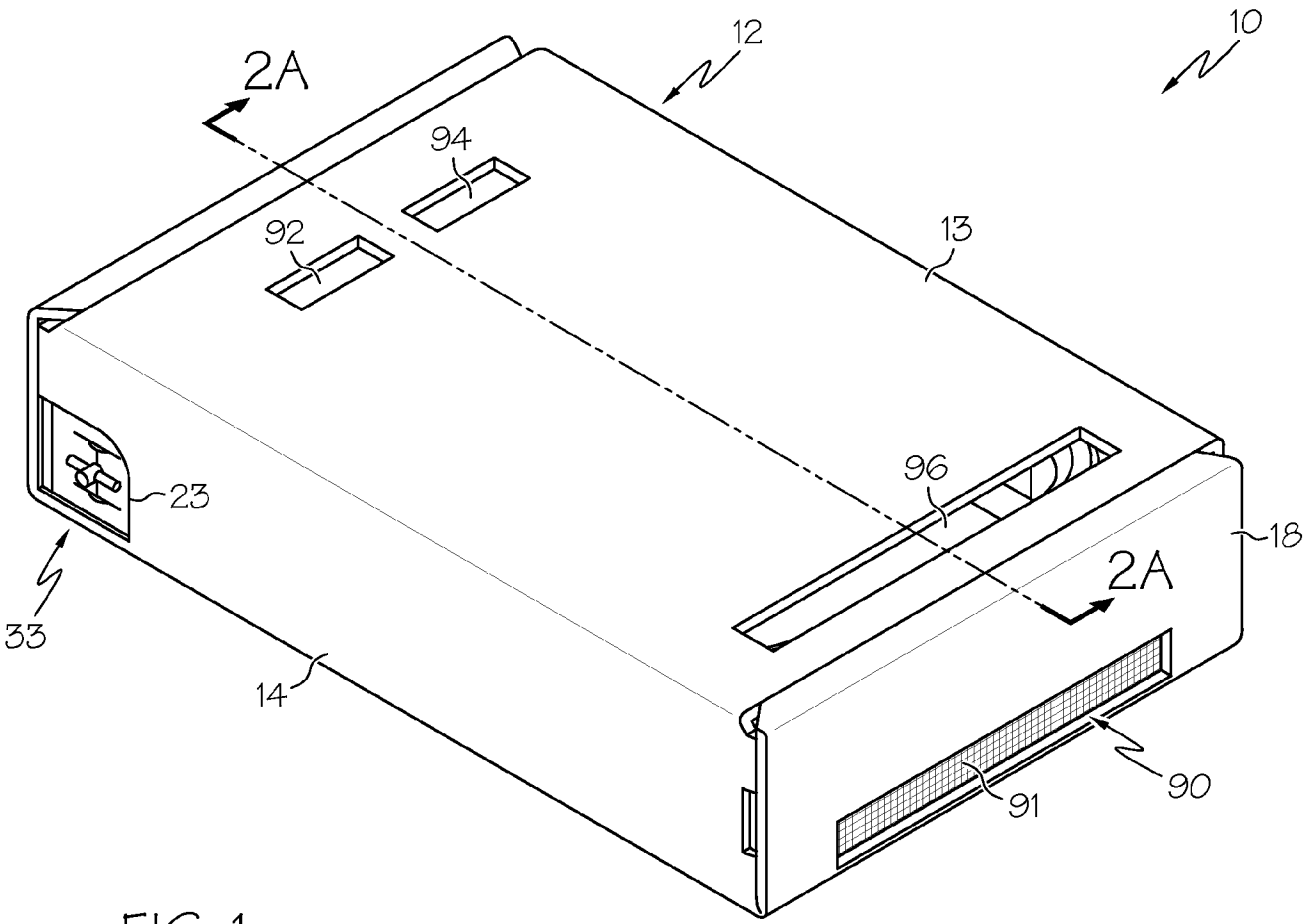
FIG. 1 is a perspective front view of an exemplary heated field ration in a closed position according to one or more embodiments of the present disclosure.
Figure 2:
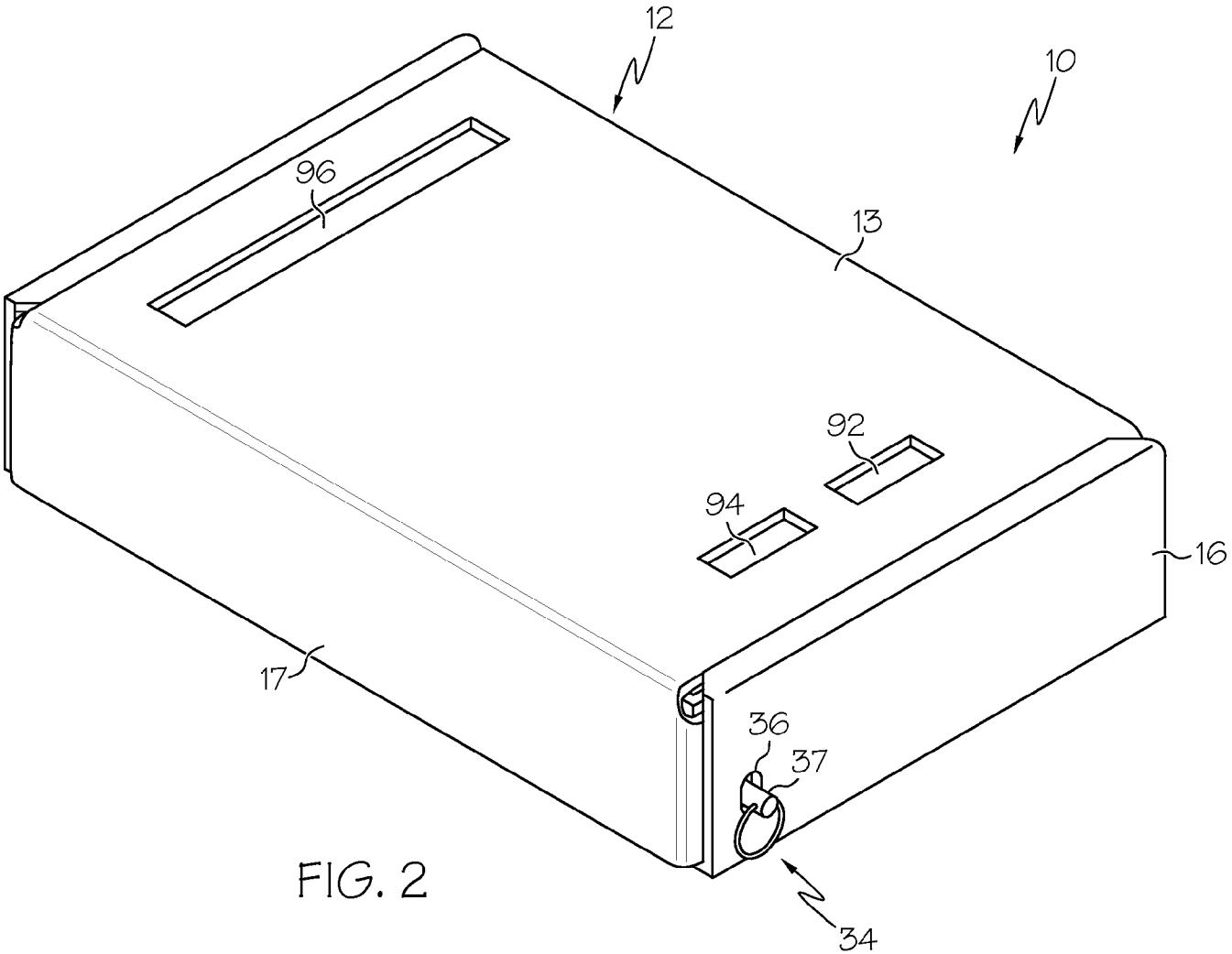
FIG. 2 is a perspective rear view of an exemplary heated field ration in a closed position according to one or more embodiments of the present disclosure.
Figure 3:
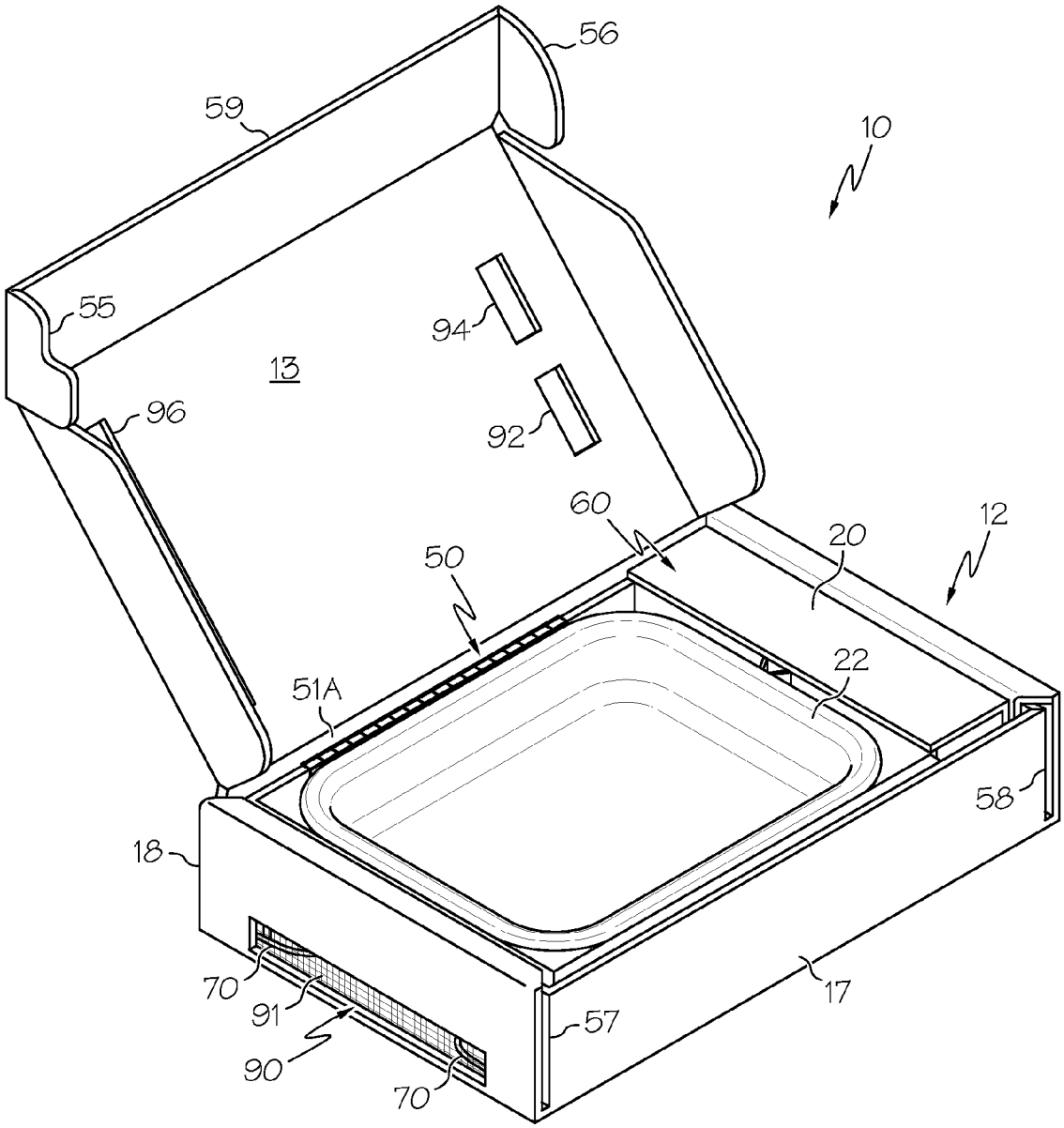
FIG. 3 is a perspective front view of an exemplary heated field ration in an open position according to one or more embodiments of the present disclosure.
Figure 10A:
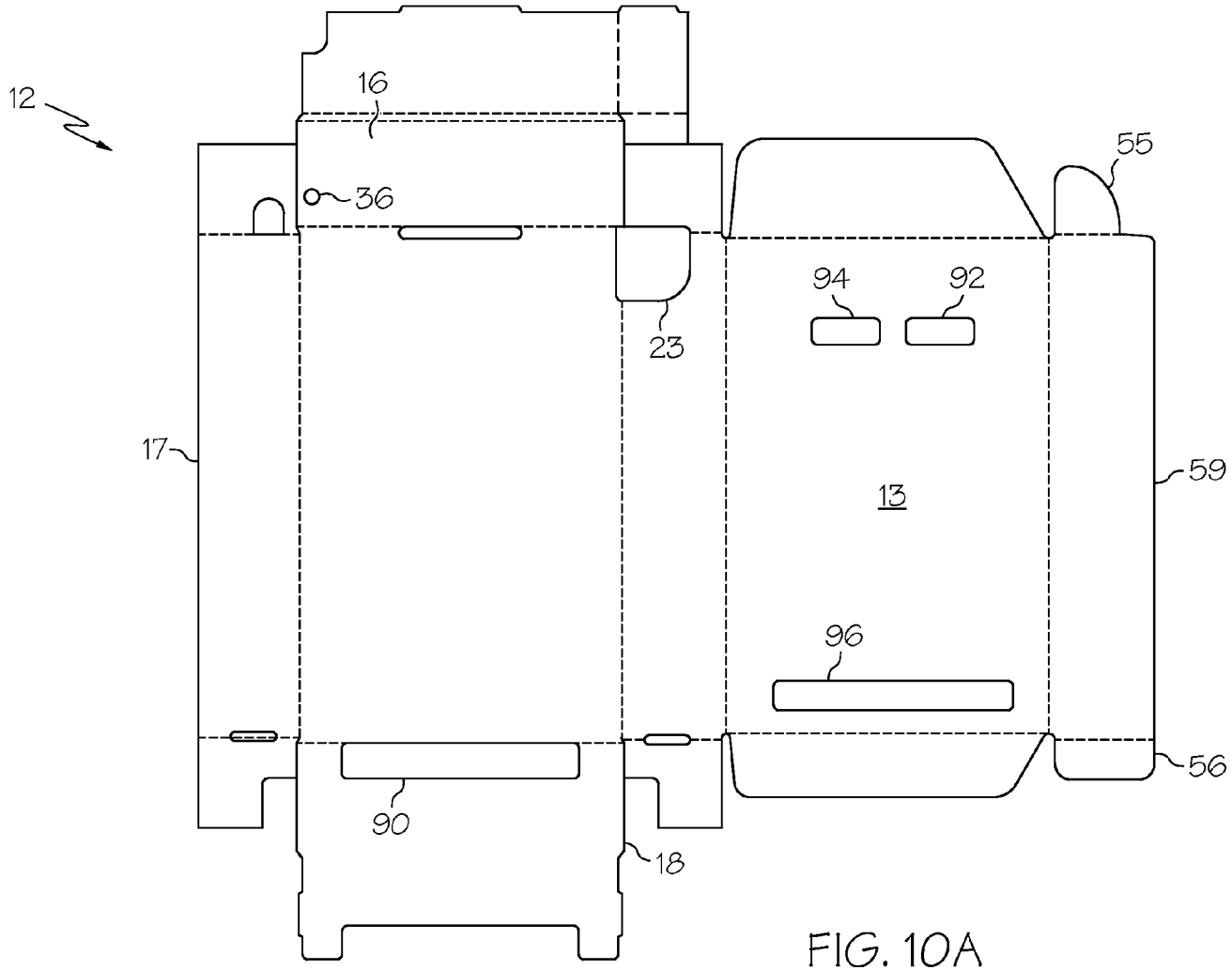
FIG. 10A is a top view of an exemplary ration housing in an unfolded position according to one or more embodiments of the present disclosure.

Referring to FIGS. 1-3, an exemplary heated field ration or field ration packaging assembly 10 is illustrated. The exemplary heated field ration 10 may be of any desired size (e.g., an MRE for feeding an individual or a large UGR for feeding many individuals), and may comprise a ration housing 12 (best illustrated in FIGS. 1 and 3) that defines an enclosure 15 (see FIG. 5) that encloses the modular components and food items of the heated field ration 10. The ration housing 12 may be made of any material that is capable of withstanding the elevated temperatures generated by the ration heater system as well as providing insulating properties. Exemplary materials include, but are not limited to, paperboard materials (e.g., corrugated cardboard), plastics, composites, metals and other similar materials or combinations thereof. The embodiment illustrated in FIGS. 1 and 2 comprises a ration housing 12 that is folded into an exemplary field ration shape. FIG. 10A illustrates an exemplary ration housing 12 in an unfolded state. However, it is contemplated that the ration housing 12 may also be formed into a field ration shape by other means, such as molding, for example.

The ration housing 12 may comprise one or more vents (e.g., 90, 92, 94 and 96) for the intake of fresh ambient air and for exhausting carbon dioxide, water vapor and excess heat produced by the catalytic reaction. In the illustrated embodiment, one side (e.g., wall panel 18) of the ration housing 12 comprises an intake vent 90, which has an optional protective screen 91 positioned within to prevent a user's fingers from inadvertently entering the intake vent 90 and touching the heat source housed within the enclosure 15 defined by the ration housing 12. The intake vent 90, which is not limited to the illustrated configuration and may be of any configuration and size, allows ambient air to enter the enclosure 15 and pass over the source (e.g., heat pad assembly 80, see FIG. 4). In other embodiments, multiple intake vents may be provided.

The ration housing 12 may also have one or more exhaust vents (e.g., exhaust vents 92 and 94) positioned on a lid panel 13. The exhaust vents 92, 94 may be located at an exhaust end of the ration housing 12 that is opposite of the end in which the intake vent 90 is located such that air may travel across the heat pad assembly 80 (discussed later herein) before exiting the enclosure 15. A second intake vent (e.g., recirculation vent 96) may also be provided on the lid panel 13 of the ration housing 12 at the air intake end to facilitate recirculation of air into the enclosure 15 and across the food item and heat source.

Also illustrated in FIGS. 1 and 2 are exemplary activation mechanisms for activating the thermal catalytic reaction. As illustrated, a first activation mechanism 34 (see pull-pin 37) and a second activation mechanism 33 are provided. The two activation mechanisms may be provided as a feature to prevent inadvertent activation of the heated field ration 10 during transport or handling, for example. It is contemplated that a single activation mechanism or more than two activation mechanisms may also be utilized.

Referring now to FIG. 3, an exemplary field ration packaging assembly 10 is illustrated in an open position. The lid panel 13 of the ration housing 12 comprises side flaps 55 and 56 laterally disposed along flap 59 that may be inserted into slots 57 and 58 to place the field ration packaging assembly 10 into a closed position. In some embodiments, a tray insert 60 may be provided within the enclosure 15 defined by the ration housing 12. The tray insert 60 may include a fuel cartridge housing 20 that retains a fuel cartridge 30 and provides support for tray support 50 and food tray 22 (shown as empty). Food items to be heated and consumed by the user are maintained within the food tray 22. The food tray 22 may be made of a plastic material capable of withstanding heat generated by the heat pad assembly, such as polypropylene, for example. The food tray 22 may also be made of a metallic or composite material. The tray insert 60 may be made of suitable materials as those used for the ration housing 12, such as cardboard, metal, or plastic, for example. In the exemplary field ration 10 illustrated in FIG. 3, a tray support 50, which may be a configured as a grate made of a material capable of conducting heat (e.g., metal and/or metal alloys), straddles the tray insert 60 and supports the food tray 22.

Figure 4:
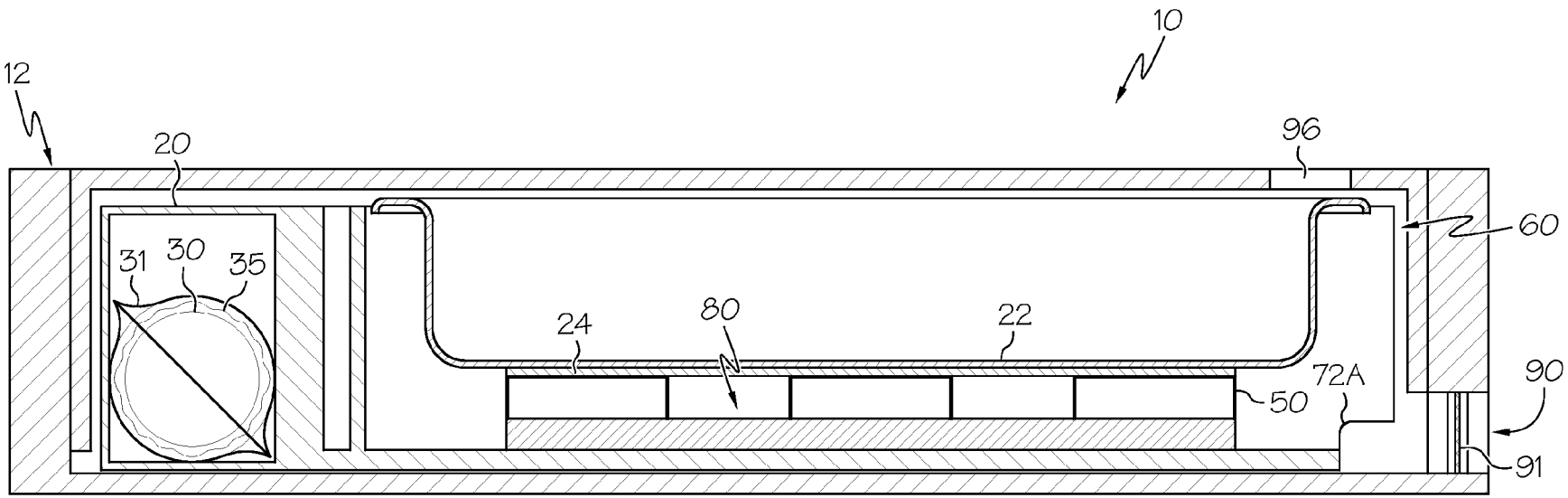
FIG. 4 is a cross-sectional view of an exemplary heated field ration in a closed position along plane 2A according to one or more embodiments of the present disclosure.
Figure 5:
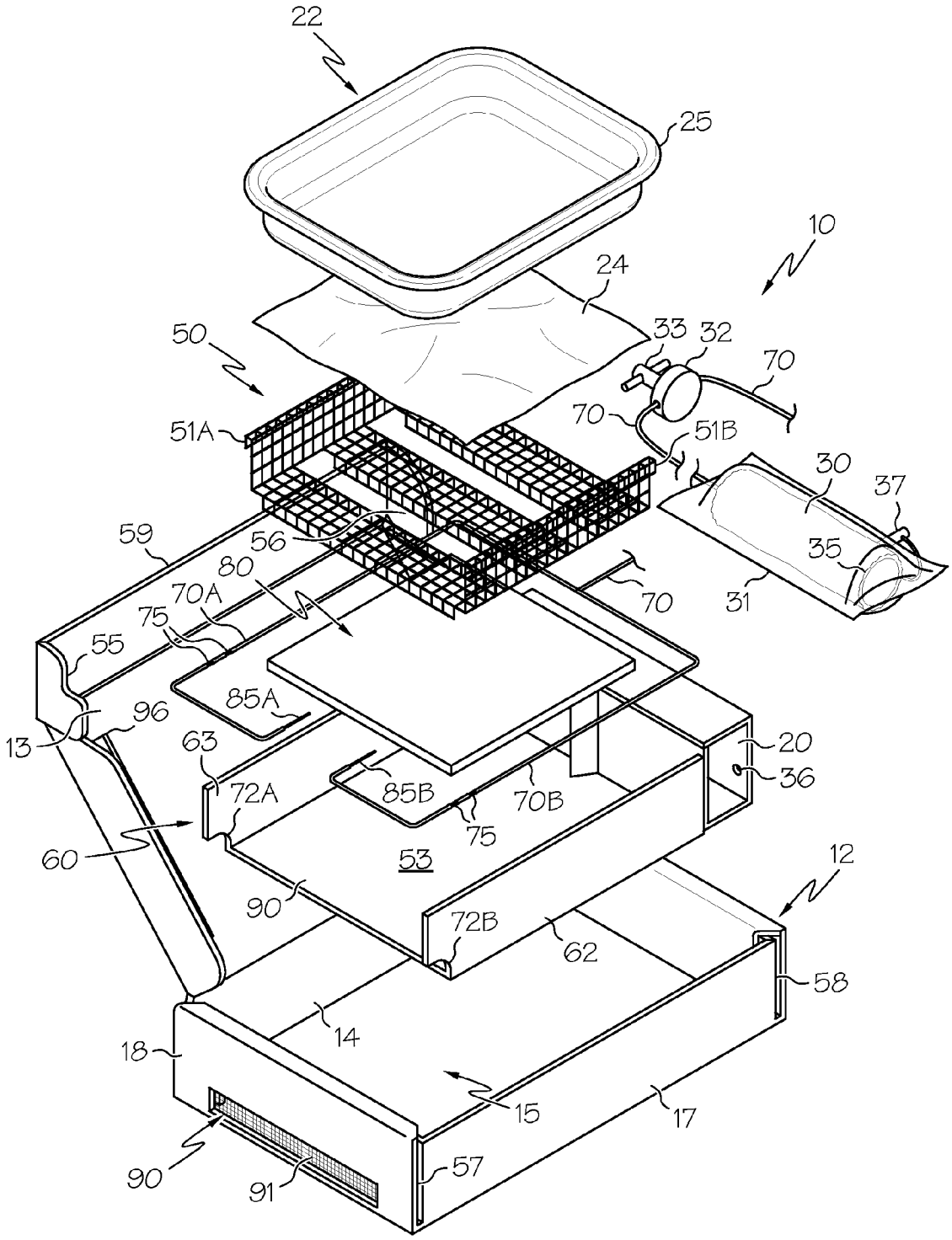
FIG. 5 is an exploded perspective view of an exemplary heated field ration in an open position according to one or more embodiments of the present disclosure.
Figure 10B:
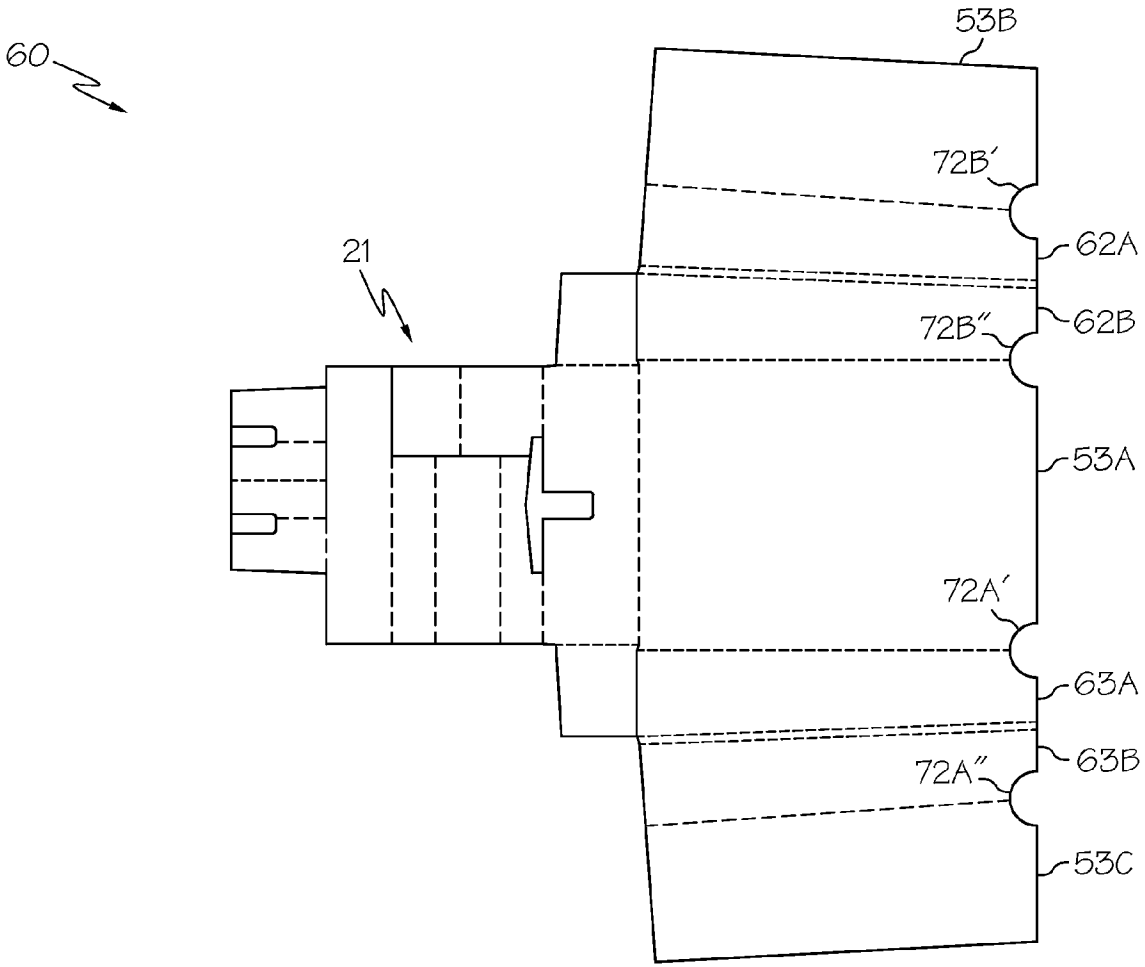
FIG. 10B is a top view of an exemplary tray insert in an unfolded position according to one or more embodiments of the present disclosure.

FIGS. 4 and 5 illustrate the modular components of an exemplary heated field ration or field ration packaging assembly 10. FIG. 4 is a cross-sectional view along plane 2A of FIG. 1, while FIG. 5 is an exploded perspective view of an exemplary heated field ration 10 in an open position. As illustrated, the tray insert 60 having a rectangular box design with an open portion and a partially enclosed fuel cartridge housing 20 rests within the enclosure 15. The fuel cartridge housing 20 may be positioned at one end of the tray insert 60 to allow air to flow into the intake vent 90 and out of the exhaust vent or vents 94, 92. A fuel cartridge 30 containing liquid fuel for reacting with both ambient air and the catalyst provided within the heat pad assembly 80 may be positioned within fuel cartridge housing 20. The tray insert 60 may also have a heat source support panel 53 in which a heat pad assembly 80 (described hereinbelow) may be positioned. FIG. 10B illustrates an exemplary tray insert 60 in an unfolded state which may be folded into a tray insert structure prior to the assembly of the heated field ration 10. Flap portion 21 may be folded over to create the fuel cartridge housing 20 that is illustrated in FIG. 5. Portions 62A and 62A, as well as portions 63A and 63B, may be folded to create tray insert walls 62 and 63, respectively. Portions 53B and 53C may be folded over to rest upon portion 53A, thereby creating the heat source support panel 53. The notches 72A', 72A", 72B' and 72B" may align after folding the tray insert 60 to form fuel line holes 72A and 72B, respectively (see FIG. 5). It is contemplated that the tray insert 60 may be made by other methods, such as molding, for example.

The exemplary tray support 50 illustrated in FIGS. 4 and 5 comprises a grate having three horizontal slats and first and second flanges 51A and 51B for engaging the tray insert walls 62 and 63 of the tray insert 60. The tray support 50 may be shaped and configured to accept and support the food tray 22, and to conduct and transfer heat radiated from the heat source to the food items within the food tray 22 (e.g., such as through mesh design). The tray support 50 is not limited to the configuration as illustrated in FIGS. 4 and 5. In another embodiment, the tray support 50 may not have three slats but rather a single surface, for example. The tray support 50 may also be configured to engage tray insert 60 in any suitable manner, such as by way of tabs and corresponding slots, for example. In another embodiment, the tray insert 60 and tray support 50 may be integrally formed within the ration housing 12.

In the illustrated embodiment, the field ration packaging assembly 10 comprises a heat guide 24 that is positioned on a food tray supporting surface of the tray support 50. The food tray 22 rests on the heat guide 24 and is maintained by the tray support 50. The heat guide 24 may be made of a material capable of absorbing and dissipating heat generated by the heat pad assembly 80 that is positioned below the tray support 50. The heat guide 24 may be made of a metallic material, such as aluminum, for example. The heat guide 24 may be of a thickness such that heat is absorbed and dissipated evenly. The heat guide 24 may prevent uneven regions of relatively high heat (i.e., "hot spots") from reaching the food tray 22, thereby enabling an even heat distribution to the food tray 22. In one embodiment, the heat guide 24 may comprise an aluminum foil having a black coloring to enhance heat absorption. The black coloring may be applied to the aluminum foil by a printing process, such as a rotogravure or a flexographic printing process, for example. The heat guide 24 may also be attached directly to the food tray 22. In other embodiments, a heat guide 24 may not be utilized and the food tray 22 may rest directly on the tray support 50.

In other embodiments, the tray support 50 and tray insert 60 may be configured as a single tray support unit and not as two distinct components. For example, the tray support of this embodiment may provide a surface in which the heat pad assembly 80 may rest, and may comprise a fuel cartridge housing 20 and a tray support surface in which the food tray 22 may be held. Other embodiments may utilize only a tray insert 60 and not a tray support 50 to retain the food tray 22 within the heated field ration housing 12. The food tray 22 may have a flange 25 that runs around the perimeter of the food tray 22 and engages the first and second tray insert walls 62 and 63 of the tray insert 60. In such an embodiment, food tray 22 may be supported by flange 25. Hence, the food tray 22 is not coupled to the heat pad assembly 80 on a bottom surface in this embodiment such that air can pass between food tray 22 and the heat source or heat pad assembly 80. In another embodiment, food tray 22 may be supported by tray support 50 and/or flange 25. In another embodiment, the heat pad assembly 80 may be coupled directly to a bottom surface of the food tray 22, which may be made of a thermally conductive material, such as metal and/or metal alloys, for example.

An exemplary flameless ration heater system 19 as illustrated in FIGS. 6-9 will now be described. Generally, the heater system may include, but is not limited to, a fuel cartridge 30, first and second activation mechanisms 34, 33 in fluid communication with the fuel cartridge 30, fuel lines 70, 70A and/or 70B, fuel delivery capillaries 85A and 85B, and heat pad assembly 80.

Figure 6:
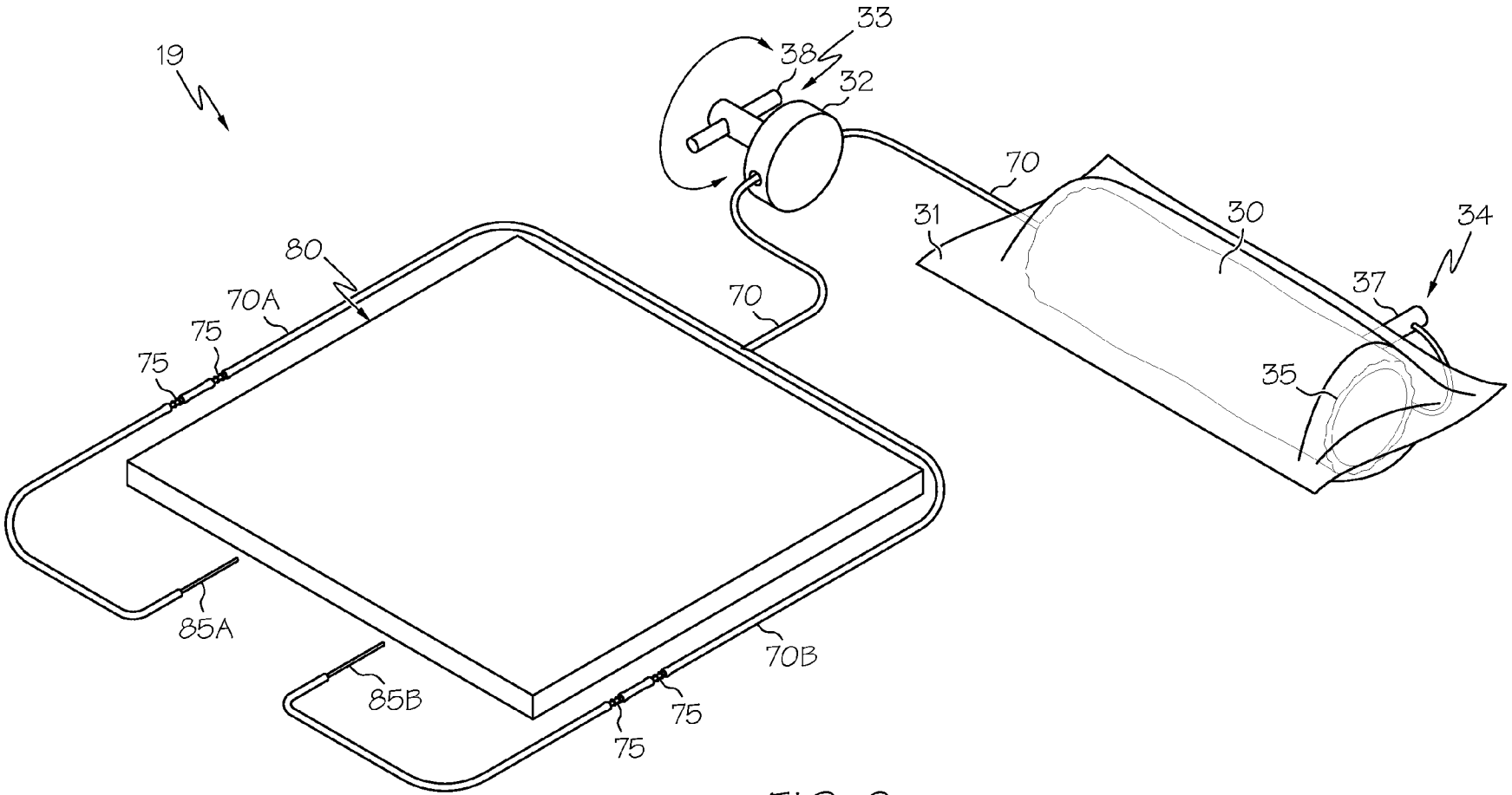
FIG. 6 is a perspective view of an exemplary flameless ration heater assembly according to one or more embodiments of the present disclosure.
Figure 7:
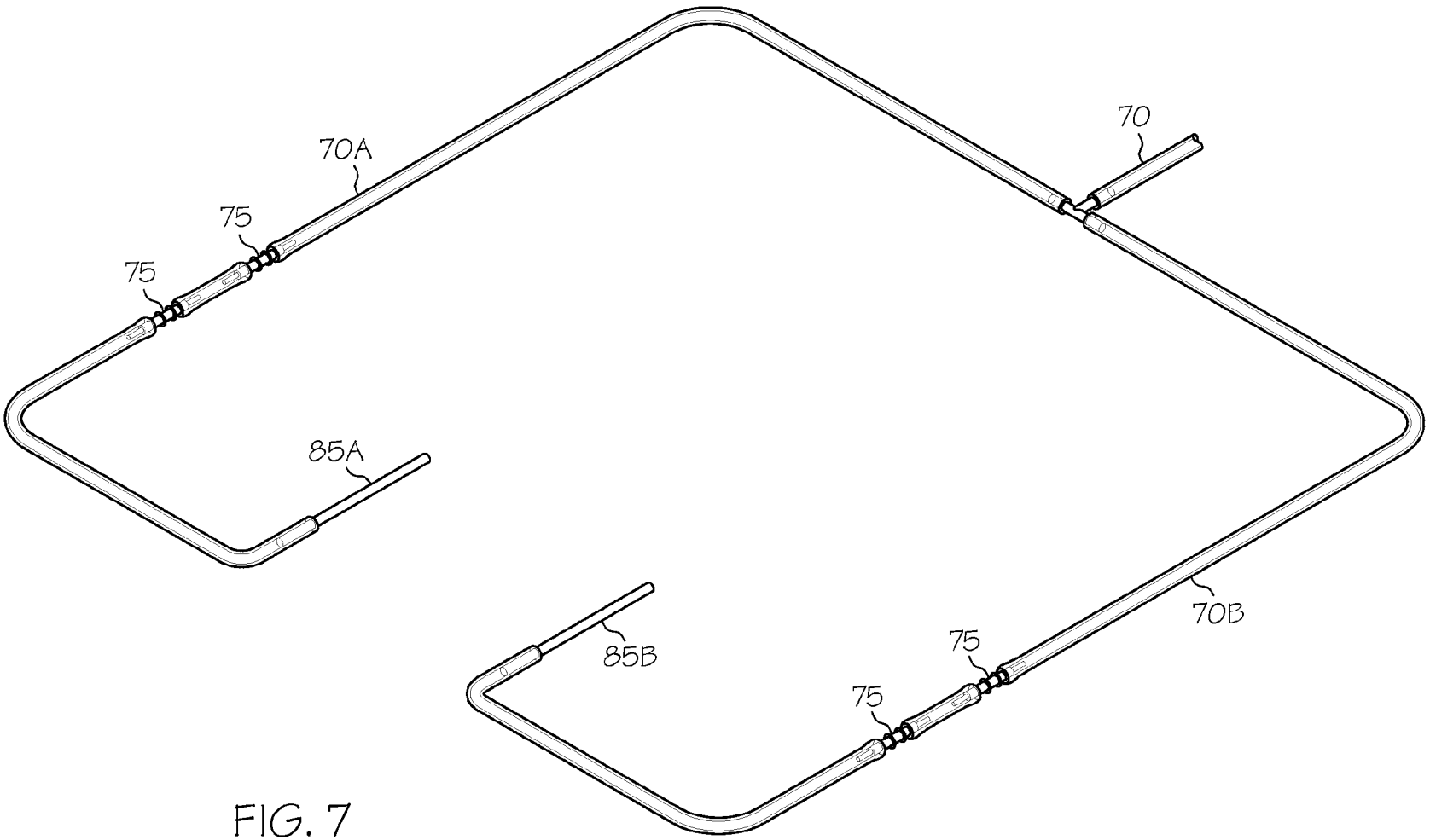
FIG. 7 is a perspective view of an exemplary fuel line assembly according to one or more embodiments of the present disclosure.

As illustrated, the fuel cartridge 30 is configured as cylinder that stores liquid fuel in an inner chamber. To prevent inadvertent flow or spillage of fuel from the fuel cartridge 30 due to a puncture or other failure of the fuel cartridge 30, the fuel cartridge 30 may be wrapped in a fuel absorbent material 35. The fuel absorbent material 35 may absorb and retain fuel that may unintentionally leak from the fuel cartridge 30. As illustrated in FIGS. 5 and 6, the fuel absorbent material 35 may be wrapped around the fuel cartridge 30 and sealed in a fuel cartridge wrapping 31. The fuel cartridge wrapping 31, which may be made of plastic or other materials that are not permeable to methanol or other types of fuel, may further prevent the flow of fuel from the fuel cartridge 30 to the surrounding environment. In other embodiments, the fuel cartridge 30 may not be wrapped in a fuel absorbent material, as illustrated in FIG. 8.

Activation mechanisms may be utilized to initiate and/or control the flow of fuel from the fuel cartridge 30 to the heat pad assembly 80 (described in detail below). Referring to the exemplary heating system illustrated in FIGS. 6 and 9, the first activation mechanism 34 (e.g., pull-pin 37) may be located at a first end of the fuel cartridge 30 while the second activation mechanism 33 may be located along wall panel 14 at housing opening 23, as illustrated in FIG. 1.

Figure 9:
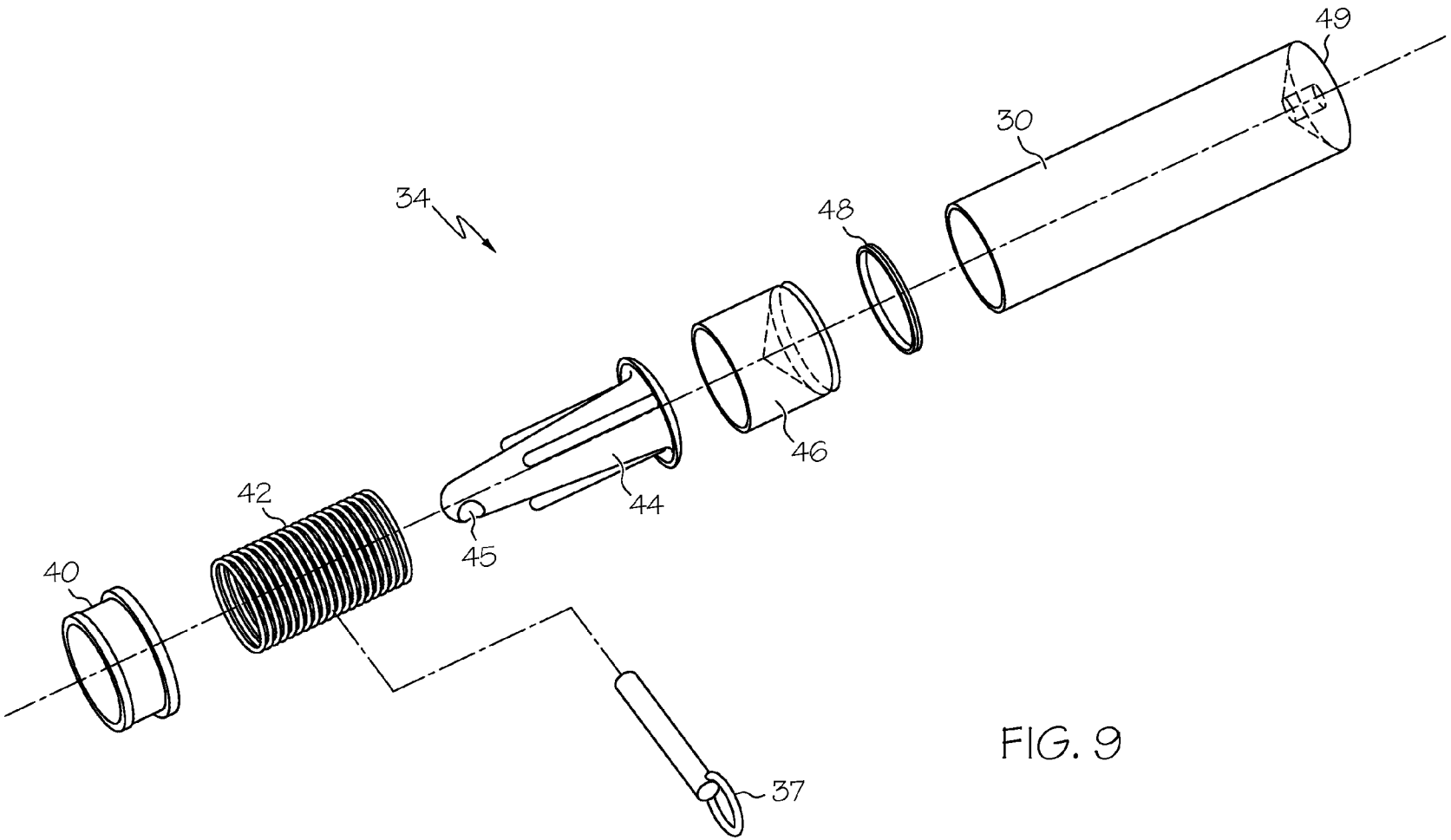
FIG. 9 is an exploded view of an exemplary fuel cartridge according to one or more embodiments of the present disclosure.

The exemplary first activation mechanism 34 illustrated in FIG. 2 comprises a pull-pin 37 that protrudes out of wall panel 16 through opening 36. As illustrated in FIG. 9, the first activation mechanism 34 may further comprise a gasket 48 positioned on a plunger 46. Within or upon the plunger 46 may rest a spring cone 44 that accepts a spring 42. The spring 42 may be compressed upon the spring cone 44 with a cap 40 such that the spring 42 and cap 40 are positioned below a pull-pin recess 45 (i.e., the spring 42 may be compressed between the pull-pin recess 45 and plunger 46). The pull-pin 37 may be inserted into the pull-pin recess 45 to retain the cap 40 and spring 42 on the spring cone 44. The spring 42, spring cone 44, plunger 46 and gasket 48 may be positioned within the fuel cartridge 30, which may contain fuel. The cap 40 may then be secured to the fuel cartridge 30 by threads or other attachment means. The fuel cartridge 30 may further comprise a nozzle end 49 in which fuel may flow upon the activation of pull-pin 37 (i.e., removing pull-pin 37 from the pull-pin recess 45).

Figure 8:
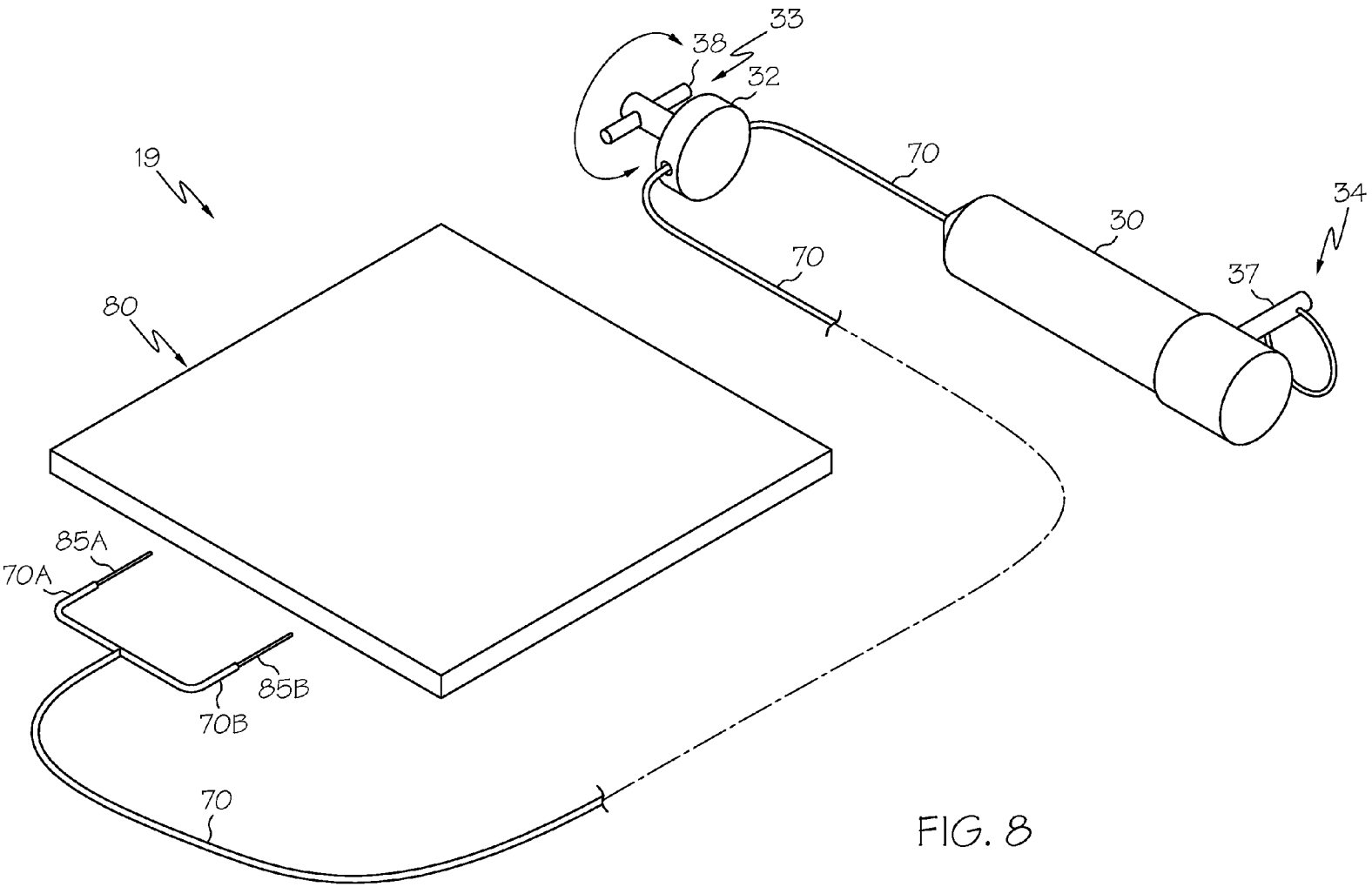
FIG. 8 is a perspective view of an exemplary flameless ration heater assembly according to one or more embodiments of the present disclosure.

Referring to FIGS. 6 and 8, the second activation mechanism 33 may comprise an ON/OFF control 38 that is coupled to a valve assembly 32 having a valve. The second activation mechanism 33 may be coupled to the fuel cartridge 30 via the fuel line 70. The valve assembly 32, which may be controlled by the second activation mechanism 33, may be configured to allow fuel to flow toward the heat pad assembly 80 when the second activation mechanism 33 is in the "ON" position. In one embodiment, the second activation mechanism 33 and valve assembly 32 may cooperate to control the flow rate of fuel through the valve assembly 32, thereby controlling the amount of fuel that reaches the heat pad assembly 80. It is contemplated that the first and second activation mechanisms 34, 33 are not limited to the pull-pin 37 and ON/OFF control 38 configurations as illustrated in FIGS. 1 and 2. For example the first and second activation mechanisms 34, 33 may include, but are not limited to, toggle switches, push-button switches, solenoids and any other mechanism that is configured to selectively allow fuel to flow toward the heat pad assembly 80.

As described above, a fuel line 70, which may be made of any suitable material, may run from the fuel source (e.g., fuel cartridge 30) to the valve assembly 32, and then toward the heat pad assembly 80. In embodiments that utilize only one activation mechanism, such as the first activation mechanism 34 describe above, the fuel line 70 may run from the fuel cartridge 30 directly to the heat pad assembly 80.

Referring to FIGS. 5-8, after exiting the valve assembly 32, the fuel line 70 may split into two fuel line segments 70A and 70B that run along each side of the heat pad assembly 80 and enter the heat pad assembly 80 at a fuel entry end. The fuel lines 70A and 70B may be positioned in the space between the tray insert 60 and the ration housing 12 (e.g., between tray insert walls 62 and 63 of the tray insert 60 and wall panels 17 and 14 of the ration housing 12, respectively). The fuel lines 70A and 70B may enter the tray insert 60 via fuel line holes 72A and 72B as illustrated in FIGS. 4 and 5. The heat pad assembly 80 may be positioned in a central location within the tray insert 60 on heat source support panel 53. The two fuel lines 70A and 70B may run to the opposite side of the tray insert 60 (see FIG. 5) and may be coupled to fuel delivery capillaries 85A and 85B, respectively (see FIG. 7). The fuel delivery capillaries 85A and 85B may be an integral component of the fuel lines 70A and 70B, or may be connected to the fuel lines 70A and 70B by coupling means.

The fuel delivery capillaries 85A and 85B may be configured to evenly distribute fuel to the heat pad assembly 80. In one embodiment, the fuel delivery capillaries 85A and 85B may have a plurality of holes through which fuel enters the heat pad assembly 80. The fuel line 70 may also be configured such that it is not split into two fuel lines 70A and 70B but rather enters the heat pad assembly 80 as a single tube or line. The fuel line 70 may also run along only one side of the heat pad assembly 80 and then split into fuel lines 70A and 70B just prior to entering the heat pad assembly 80, as illustrated in FIG. 8.

Some embodiments may further comprise fuel restrictors 75 within the fuel lines 70, 70A and/or 70B to control the rate of fuel flow from the fuel cartridge 30 to the heat pad assembly 80. Referring to the embodiment illustrated in FIG. 7, the fuel restrictor 75 may be a capillary tube having a diameter that is smaller than the diameter of the fuel line 70, 70A and/or 70B. The smaller diameter of the fuel restrictor 75 reduces the flow of fuel. Fuel restrictors 75 may be coupled in series along the fuel line 70, 70A and/or 70B to reduce the flow rate of the fuel. Although the exemplary embodiment illustrated in FIGS. 5-7 has fuel restrictors coupled along fuel lines 70A and 70B, the fuel restrictors 75 may also be coupled along fuel line 70 prior to splitting into fuel lines 70A and 70B.

Any number of fuel restrictors 75 may be added to the flameless ration heater system 19 to control the amount of heat generated. For example, to reduce the amount of heat provided by the heat pad assembly 80, the number of flow restrictors 75 may be increased. Conversely, fewer fuel restrictors 75 may be used if more heat is desired. Fuel restrictors 75 may be easily added or removed from the fuel lines 70, 70A and/or 70B by coupling the fuel restrictor 75 into the existing fuel line. The number of fuel restrictors 75 may be determined based upon the type of food that is to be heated. As an example and not a limitation, a field ration containing proteins, vegetables and/or starches may comprise two fuel restrictors 75 within each fuel line segment 70A and 70B for a total of four fuel restrictors 75. A field ration containing desserts may require less heat, and therefore may utilize four fuel restrictors 75 within each fuel line segment 70A and 70B for a total of eight fuel restrictors 75. Other fuel restrictor 75 configurations are also possible. For example, the fuel restrictor 75 may be a capillary or other fuel restriction device maintained within the fuel line 70, 70A and/or 70B by wire (i.e., not coupled to the fuel line but held within).

FIGS. 6 and 8 illustrate heat pad assembly 80 in schematic. As previously discussed, heat pad assembly 80 may comprise those disclosed in U.S. Pub. No. 2004/0209206 or other heat pad assemblies known in the art. For example, the heat pad assembly 80 may comprise a heat shield, a permeable membrane and a catalyst layer. The heat shield may be made of a thermally conductive material such as a metal foil, for example, and provide for an even heat distribution toward the food tray 22 and food item or items. The heat pad assembly 80 may be configured to accept the fuel delivery capillaries 85A and 85B through slots. Positioned adjacent the exemplary heat shield may be the permeable membrane, which may be configured to allow fuel to diffuse and mix with ambient air to form a fuel vapor. The permeable membrane may be a silicone rubber membrane, a permeable coating on a fibrous substrate, or any other configuration that diffuses the liquid fuel so that it is converted into a fuel vapor, including, but not limited to, those as disclosed in U.S. Pub. No. 2004/0209206.

The catalyst layer may be positioned adjacent the permeable membrane. As disclosed in U.S. Pub. No. 2004/0209206, the catalyst layer may comprise noble metal catalyst particles (such as platinum or ruthenium) that are incorporated into a high temperature, high performance fiber such as a felt of plybenzoxazol. Other felts may include, but are not limited to, fibers of polybenzimidazole, polyimides, alumina, fiber glass, zirconia, quartz and p-aramids felts. Alternatively, the catalyst may be coated directly onto the fibers of the felt. The catalyst may be coated or deposited onto the felt by airbrush spraying, for example. The catalyst is capable of breaking down the fuel vapor and oxidizing it with the oxygen provided by the air entering at the intake vents 90 and 96. The permeable membrane and catalyst layer may be secured to the heat shield. In other embodiments, the heat pad assembly 80 may include only one layer that is both the permeable membrane and the catalyst layer. The catalyst may be dispersed within the permeable membrane rather than a separate fibrous catalyst layer, or the fibrous catalyst layer may also be configured as the permeable membrane.

Figure 11:
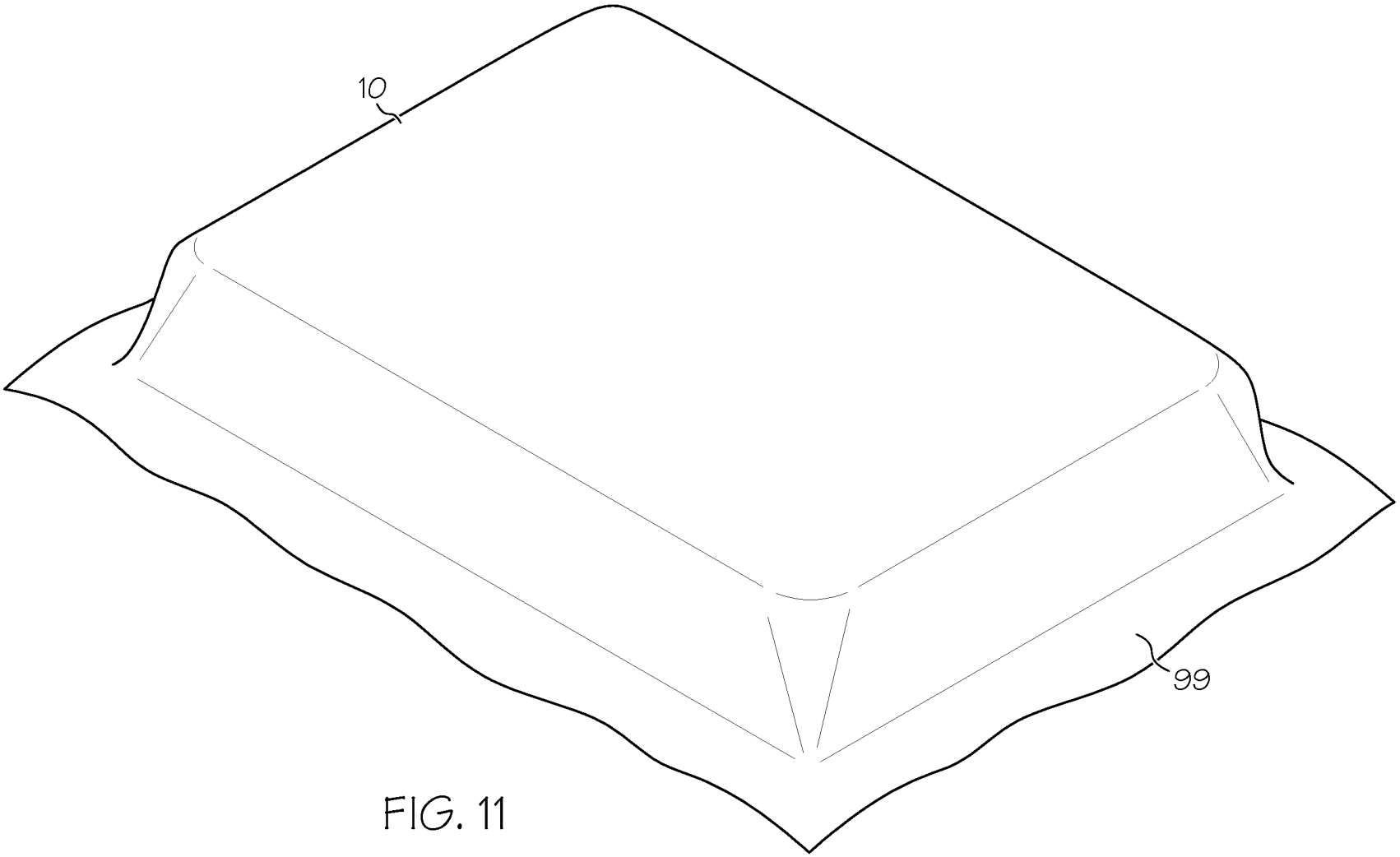
FIG. 11 is a perspective view of an exemplary heated field ration wrapped in an exemplary bag according to one or more embodiments of the present disclosure.

With the aforementioned components positioned within the enclosure 15, the lid panel 13 of the ration housing 12 may be closed and side flaps 55 and 56 may be inserted into slots 57 and 58 defined by the folded ration housing 12. The heated field ration 10 may then be sealed in a bag 99 (e.g., a plastic bag as shown in FIG. 11) to protect the heated field ration 10 and the contents within from environmental exposure.

Referring to the figures, the operation of an exemplary heated field ration 10 will now be described. The heated field ration or field ration packaging assembly 10 may be unwrapped by removing a plastic bag 99 if a plastic bag is used to wrap the heated field ration 10 (see FIG. 11). The heated field ration 10 may then be activated by performing a two-step activation operation which may be performed in any order. As described hereinabove, more or fewer activation operations may be required to initiate the catalytic reaction. To initiate the first activation mechanism 34, the pull-pin 37 located on side 16 of the ration housing 12 may be pulled outwardly away from the heated field ration 10. Referring to FIG. 9, when the pull-pin 37 is removed from pull-pin recess 45, the spring 42 may be released and move spring cone 44, plunger 46 and gasket 48 toward the nozzle end 49. The plunger 46 may then push the fuel out of the nozzle end 49 and into the fuel line 70. As previously discussed, embodiments are not limited to the exemplary fuel cartridge 30 and activation assembly illustrated in FIG. 9 as other activation mechanisms may be utilized.

After activation of the pull pin 37, the fuel then travels through the fuel line 70 to the valve assembly 32. The control 38 of the second activation mechanism 33 may be moved from the "OFF" position to the "ON" position. The valve assembly 32 therefore transitions from a closed state to an open state, thus allowing the fuel to continue through the fuel line segments 70A and 70B toward the heat pad assembly 80. The fuel enters the heat pad assembly 80 through fuel delivery capillaries 85A and 85B. In some cold weather applications, a secondary heating source may be utilized to condition portions of the heat pad assembly to aid in initiating the exothermic reaction. The fuel traverses, and is distributed across, the heat pad assembly 80. The fuel is absorbed and diffused by the permeable membrane, mixes with the oxygen of the air, and transitions into a fuel vapor. The fuel vapor reacts with the catalyst provided within the catalyst layer, which oxidizes the hydrocarbons and carbon monoxide of the fuel.

The catalytic reaction produces heat, water and carbon dioxide. As the temperature of the heat pad assembly 80 rises, air is drawn into the intake vent 90, and carbon dioxide and water vapor exit the heated field ration 10 at exhaust vents 92 and 94. An additional recirculation intake vent 96 may allow air to recirculate into the enclosure 15 and pass over the top of the food tray 22. The incoming air at the intake vent 90 facilitates the movement of fuel and fuel vapor over the heat pad assembly 80, thus increasing the efficiency of the reaction (i.e., natural convention). Because of the placement of the intake vents 90 and 96 and the exhaust vents 92 and 94, the heated field ration 10 may operate similar to a convection oven (natural convention) to quickly warm the food items within the food tray 22 (i.e., the air is warmed when it is passed across the heat pad assembly 80 and then flows across the food tray 22).

The food items may be ready to eat after a period of time elapses. When the food items are sufficiently heated, the side flaps 55 and 56 may be removed from the respective slots 57 and 58 and the lid panel 13 of the ration housing 12 lifted. The food tray 22 may then be removed from the tray support 50 and any wrappings on the food tray 22 may be removed. The heated food may then be consumed. Because hydrogen gas is not produced by the described exothermic reactions, one or many heated field rations 10 may be activated and consumed in close proximity to one another in an enclosed space, such as a mess hall or tent.

The foregoing description of the various embodiments and principles of the inventions has been presented for the purpose of illustration and description. It is not intended to be exhaustive or to limit the inventions to the precise forms disclosed. Many alternatives, modifications and variations will be apparent to those skilled in the art. Moreover, although many inventive aspects have been presented, such aspects need not be utilized in combination, and various combinations of inventive aspects are possible in light of the various embodiments provided above. Accordingly, the above description is intended to embrace all possible alternatives, modifications, combinations and variations that have been discussed or suggested herein, as well as others that fall within the principles, spirit, and broad scope of the various inventions as defined by the claims.

It is noted that recitations herein of a component of the present invention being "configured" to embody a particular property, or function in a particular manner, are structural recitations as opposed to recitations of intended use. More specifically, the references herein to the manner in which a component is "configured" denotes an existing physical condition of the component and, as such, is to be taken as a definite recitation of the structural characteristics of the component.

It is also noted that the use of the phrase "at least one" in describing a particular component or element does not imply that the use of the term "a" in describing other components or elements excludes the use of more than one for the particular component or element. More specifically, although a component may be described using "a," it is not to be interpreted as limiting the component to only one.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

The invention claimed is:

1. A heater system for a field ration comprising a heat pad assembly in communication with a fuel cartridge through at least one fuel line;

a first activation mechanism associated with the fuel cartridge comprising a pull-pin protruding from the fuel cartridge;

a plunger;

a spring positioned against the plunger;

a cap positioned upon the spring and secured to the fuel cartridge, wherein the cap and spring are maintained in a biased state by the pull-pin, and upon removal of the pull-pin, the spring is released, thereby pushing the plunger to enable the flow fuel within the fuel cartridge out of a nozzle end of the fuel cartridge; and a second activation mechanism located between the heat pad assembly and the fuel cartridge and comprising a valve assembly in communication with the fuel line, wherein activation of the valve assembly enables flow of fuel from the valve assembly toward the heat pad assembly through the fuel line.

2. The heater system of claim 1 wherein the fuel cartridge is wrapped with a fuel absorbent material.

3. The heater system of claim 1 further comprising at least one fuel flow restrictor positioned along the fuel line to reduce a flow rate of fuel from the fuel cartridge to the heat pad assembly.

4. The heater system of claim 1 wherein the fuel line comprises a first fuel line segment that runs along a first side of the heat pad assembly and is coupled to the heat pad assembly with a first fuel delivery capillary; and a second fuel line segment that runs along a second side of the heat pad assembly and is coupled to the heat pad assembly with a second fuel delivery capillary.

5. The heater system of claim 1 wherein the second activation mechanism controls the amount of fuel that reaches the heat pad assembly.

6. A heater system comprising:

a fuel cartridge;

a catalytic heat pad assembly in communication with the fuel cartridge through at least one fuel line; and a first activation mechanism associated with the fuel cartridge comprising spring and a pull-pin protruding from the fuel cartridge, wherein the pull-pin maintains a bias against the spring to maintain the spring in a compressed state; and wherein removal of the pull-pin releases the compressed spring which pressurizes the fuel thereby enabling flow of fuel from the fuel cartridge into the fuel line; and wherein the first activation mechanism further comprises:

a plunger;

a spring cone positioned against the plunger, the spring cone having a pull-pin recess;

a spring positioned upon the spring cone; and a cap secured to the fuel cartridge, wherein the pull-pin is positioned in the pull-pin recess of the spring cone, the spring is maintained in a compressed state by the pull-pin, and upon removal of the pull-pin from the pull-pin recess, the spring pressure is released, thereby pushing the plunger to enable fuel pressure within the fuel cartridge encouraging flow of fuel out of the fuel cartridge through the one or more fuel lines toward the catalytic heat pad assembly.

7. A heater system comprising:

a fuel cartridge;

a catalytic heat pad assembly in communication with the fuel cartridge through at least one fuel line; and a first activation mechanism associated with the fuel cartridge comprising spring and a protruding from the fuel cartridge, wherein the pull-pin maintains a bias against the spring to maintain the spring in a compressed state; and wherein removal of the pull-pin releases the compressed spring which pressurizes the fuel thereby enabling flow of fuel from the fuel cartridge into the fuel line; and wherein the first activation mechanism further comprises:

a plunger with a spring retaining mechanism having a pull-pin recess;

a spring positioned upon the spring cone; and a cap secured to the fuel cartridge, wherein the pull-pin is positioned in the pull-pin recess of the plunger, the spring is maintained in a compressed state by the pull-pin, and upon removal of the pull-pin from the pull-pin recess, the spring pressure is released, thereby pushing the plunger to enable fuel pressure within the fuel cartridge encouraging flow of fuel out of the fuel cartridge through the one or more fuel lines toward the catalytic heat pad assembly.

8. A heater system comprising:

a fuel cartridge;

a catalytic heat pad assembly in communication with the fuel cartridge through at least one fuel line; and a first activation mechanism associated with the fuel cartridge comprising spring and a pull-pin protruding from the fuel cartridge, wherein the pull-pin maintains a bias against the spring to maintain the spring in a compressed state;

a second activation mechanism;

at least one fuel flow restrictor positioned along the fuel line to reduce the flow rate of fuel from the fuel cartridge to the catalytic heat pad assembly.

wherein removal of the pull-pin releases the compressed spring which pressurizes the fuel thereby enabling flow of fuel from the fuel cartridge into the fuel line;

wherein the second activation mechanism is located in one or more of (a) within the cartridge itself or (b) at one or more points along the fuel line;

wherein the second activation mechanism comprises one or more valve assemblies in communication with the fuel line; and wherein activation of the one or more valve assemblies enables flow of fuel from the valve assembly toward the catalytic heat pad assembly through the fuel line;

wherein the fuel cartridge is substantially wrapped with a fuel absorbent material; and wherein the fuel cartridge comprises two or more fuel line connectors leading to two or more fuel lines each containing its own fuel flow restrictor allowing for multiple catalytic heat pad assemblies to be used, each at an end of its own fuel line.

* * * * *